US009931684B2

(12) United States Patent
Jurich et al.

(10) Patent No.: US 9,931,684 B2
(45) Date of Patent: Apr. 3, 2018

(54) FORMING DIE AND METHOD OF USING THE SAME

(71) Applicant: Honda Motor Co., Ltd., Minato-ku, Tokyo (JP)

(72) Inventors: Milan Jurich, Dublin, OH (US); Douglas O. Staats, West Liberty, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/688,219

(22) Filed: Apr. 16, 2015

(65) Prior Publication Data

US 2015/0298195 A1 Oct. 22, 2015

Related U.S. Application Data

(60) Provisional application No. 61/981,455, filed on Apr. 18, 2014.

(51) Int. Cl.

| | |
|---|---|
| ***B21D 35/00*** | (2006.01) |
| ***B21D 22/20*** | (2006.01) |
| ***B21D 37/10*** | (2006.01) |
| ***B21D 22/22*** | (2006.01) |
| ***B21D 24/16*** | (2006.01) |

(52) U.S. Cl.

CPC ..... *B21D 35/008* (2013.01); *B21D 22/20* (2013.01); *B21D 22/22* (2013.01); *B21D 24/16* (2013.01); *B21D 37/10* (2013.01)

(58) Field of Classification Search

CPC ..... B21D 35/008; B21D 22/20; B21D 22/22; B21D 24/16; B21D 37/10; B21D 3/16

See application file for complete search history.

(56) References Cited

U.S. PATENT DOCUMENTS

| | | | | |
|---|---|---|---|---|
| 3,201,967 A | | 8/1965 | Balamuth et al. | |
| 3,643,483 A | | 2/1972 | Minchenko et al. | |
| 3,794,458 A | | 2/1974 | Iwasaki | |
| 3,879,974 A | | 4/1975 | Biddell et al. | |
| 3,910,085 A | * | 10/1975 | Biddell | B06B 1/0655 72/467 |
| 3,945,231 A | * | 3/1976 | Imazu | B21D 22/20 413/1 |
| 4,212,189 A | * | 7/1980 | Fuchs | B21J 13/02 72/342.8 |
| 4,226,111 A | | 10/1980 | Wahli | |
| 4,339,975 A | | 7/1982 | Carrieri | |
| 4,378,717 A | | 4/1983 | Schneider et al. | |

(Continued)

FOREIGN PATENT DOCUMENTS

| | | |
|---|---|---|
| CN | 103611793 A | 3/2014 |
| DE | 41 25 992 A1 | 2/1993 |

(Continued)

*Primary Examiner* — Debra Sullivan

(74) *Attorney, Agent, or Firm* — Arent Fox LLP

(57) ABSTRACT

A draw die for use in a draw stage configured to process a work piece in a forming operation is provided. The draw die includes a first segment, a second segment positioned adjacent to the first segment, and an isolation material positioned between the first segment and the second segment and configured to substantially isolate the second segment from ultrasonic vibrations of the first segment.

18 Claims, 6 Drawing Sheets

(56) References Cited

U.S. PATENT DOCUMENTS

| | | | | |
|---|---|---|---|---|
| 4,745,792 | A | 5/1988 | Story et al. | |
| 5,095,733 | A * | 3/1992 | Porucznik | B21D 22/20 72/347 |
| 5,136,907 | A | 8/1992 | Bakermans et al. | |
| 5,138,857 | A | 8/1992 | Siegert | |
| 5,588,344 | A | 12/1996 | Chun | |
| 6,021,658 | A | 2/2000 | Liinamaa et al. | |
| 6,053,027 | A | 4/2000 | Yoshizawa | |
| 6,070,521 | A | 6/2000 | Otoshi | |
| 6,199,271 | B1 | 3/2001 | Hahn et al. | |
| 6,227,090 | B1 | 5/2001 | Genseberger | |
| 6,810,704 | B2 | 11/2004 | Futamura et al. | |
| 6,862,913 | B2 | 3/2005 | Lempenauer et al. | |
| 6,871,586 | B2 | 3/2005 | Teraoka | |
| 7,102,316 | B2 | 9/2006 | Beyer et al. | |
| 7,165,437 | B2 | 1/2007 | Shin et al. | |
| 7,293,500 | B2 | 11/2007 | Futamura et al. | |
| 7,326,008 | B2 | 2/2008 | Chun et al. | |
| 7,415,862 | B2 | 8/2008 | Futamura et al. | |
| 7,421,878 | B2 | 9/2008 | Iwashita et al. | |
| 7,698,797 | B2 | 4/2010 | Hetrick et al. | |
| 7,765,848 | B2 | 8/2010 | Nagai et al. | |
| 7,958,765 | B2 | 6/2011 | Baba et al. | |
| 7,959,054 | B2 | 6/2011 | Konieczka | |
| 7,963,141 | B2 | 6/2011 | Nagai et al. | |
| 8,049,457 | B2 | 11/2011 | Okita et al. | |
| 8,443,643 | B2 | 5/2013 | Endo | |
| 8,468,866 | B2 | 6/2013 | Miyasaka et al. | |
| 2004/0031648 | A1 | 2/2004 | Rasmussen | |
| 2010/0078115 | A1 | 4/2010 | Lang | |
| 2010/0095724 | A1 | 4/2010 | Kotagiri et al. | |
| 2011/0036140 | A1 | 2/2011 | Miyasaka et al. | |
| 2011/0132209 | A1 | 6/2011 | Senda et al. | |
| 2011/0185785 | A1 | 8/2011 | Goverdhana et al. | |
| 2011/0290125 | A1 | 12/2011 | Ito et al. | |
| 2011/0308294 | A1 | 12/2011 | Erlenmaier | |
| 2012/0117772 | A1 | 5/2012 | Nagel et al. | |
| 2013/0151002 | A1 | 6/2013 | Spiesshofer et al. | |
| 2013/0180301 | A1 | 7/2013 | Schoellhammer et al. | |
| 2013/0180309 | A1 | 7/2013 | Polewski et al. | |
| 2014/0326116 | A1 * | 11/2014 | Coleman | B21D 28/14 83/14 |

FOREIGN PATENT DOCUMENTS

| | | | |
|---|---|---|---|
| DE | 4125992 | A1 | 2/1993 |
| DE | 197 51 035 | A1 | 5/1999 |
| DE | 10 2008 008 044 | A1 | 8/2009 |
| DE | 10 2008 011 375 | A1 | 9/2009 |
| DE | 10 2010 039 003 | A1 | 2/2012 |
| DE | 10 2011 075 245 | A1 | 11/2012 |
| EP | 1 222 974 | | 7/2002 |
| EP | 1 715 066 | A1 | 10/2006 |
| RU | 539658 | A1 | 12/1976 |
| WO | WO 95/24988 | A1 | 9/1995 |
| WO | WO 2012/020569 | A1 | 2/2012 |
| WO | WO 2012/123583 | A1 | 9/2012 |
| WO | WO 2012/139566 | A2 | 10/2012 |

* cited by examiner

FORMING DIE AND METHOD OF USING THE SAME

CROSS REFERENCE TO RELATED APPLICATION

This application is entitled to the benefit of, and claims priority to, provisional U.S. Patent Application Ser. No. 61/981,455 filed Apr. 18, 2014, and titled "Forming Die and Method of Using the Same", the entirety of which is hereby incorporated by reference

BACKGROUND

Some metals such as aluminum are less formable in a conventional forming press when compared to steel. Aluminum also scratches more easily which may lead to higher reject rates when compared to steel. Deep drawing of aluminum to form deep drawn parts, such as vehicle door inner panels, presents many challenges. Some vehicle manufacturers have more than four press stages in manufacturing lines, some including two draw stages, which can improve the ability to form deep drawn aluminum parts. Increasing the press stages, however, results in additional capital costs as well as more time and energy required to manufacture these deep drawn parts. Furthermore, various lubricants (e.g., oil, grease) may be employed to reduce friction between an aluminum sheet and a draw press die. These lubricants may improve deep drawing capabilities of a draw press, however, controlling the locations and amount of lubricants is challenging and the lubricants may need to be removed before further manufacturing is performed by applying the stamped work piece.

Moreover, applying ultrasonic vibrations to drilling and machining processes is known. For example, ultrasonic vibrations applied to a tool on a machining device provide a lubricating effect and may decrease tool wear and increase tool life.

SUMMARY

In one aspect, a draw die for use in a draw stage configured to process a work piece in a forming operation is provided. The draw die includes a first segment, a second segment positioned adjacent to the first segment, and an isolation material positioned between the first segment and the second segment and configured to substantially isolate the second segment from ultrasonic vibrations of the first segment.

In another aspect, a method of forming a drawn part from a work piece using a draw stage of a stamping operation, wherein the draw stage includes at least one segmented draw die and the segmented draw die includes at least a first segment and a second segment is provided. The method includes positioning the work piece within the draw stage, moving the segmented draw die toward the work piece, engaging the work piece with the segmented draw die, and ultrasonically vibrating at least one of the first segment and the second segment.

In yet another aspect, an ultrasonic segmented die system is provided. The ultrasonic segmented die system includes a segmented die that includes at least a first die segment and a second die segment, a power supply, an ultrasonic vibration generating system operatively coupled to at least one of the first die segment and the second die segment, wherein the ultrasonic vibration generating system is configured to receive power from the power supply, and a system controller communicatively coupled to, and configured to control operation of, at least one of the power supply and the ultrasonic vibration generating system.

DETAILED DESCRIPTION

Figure 1:
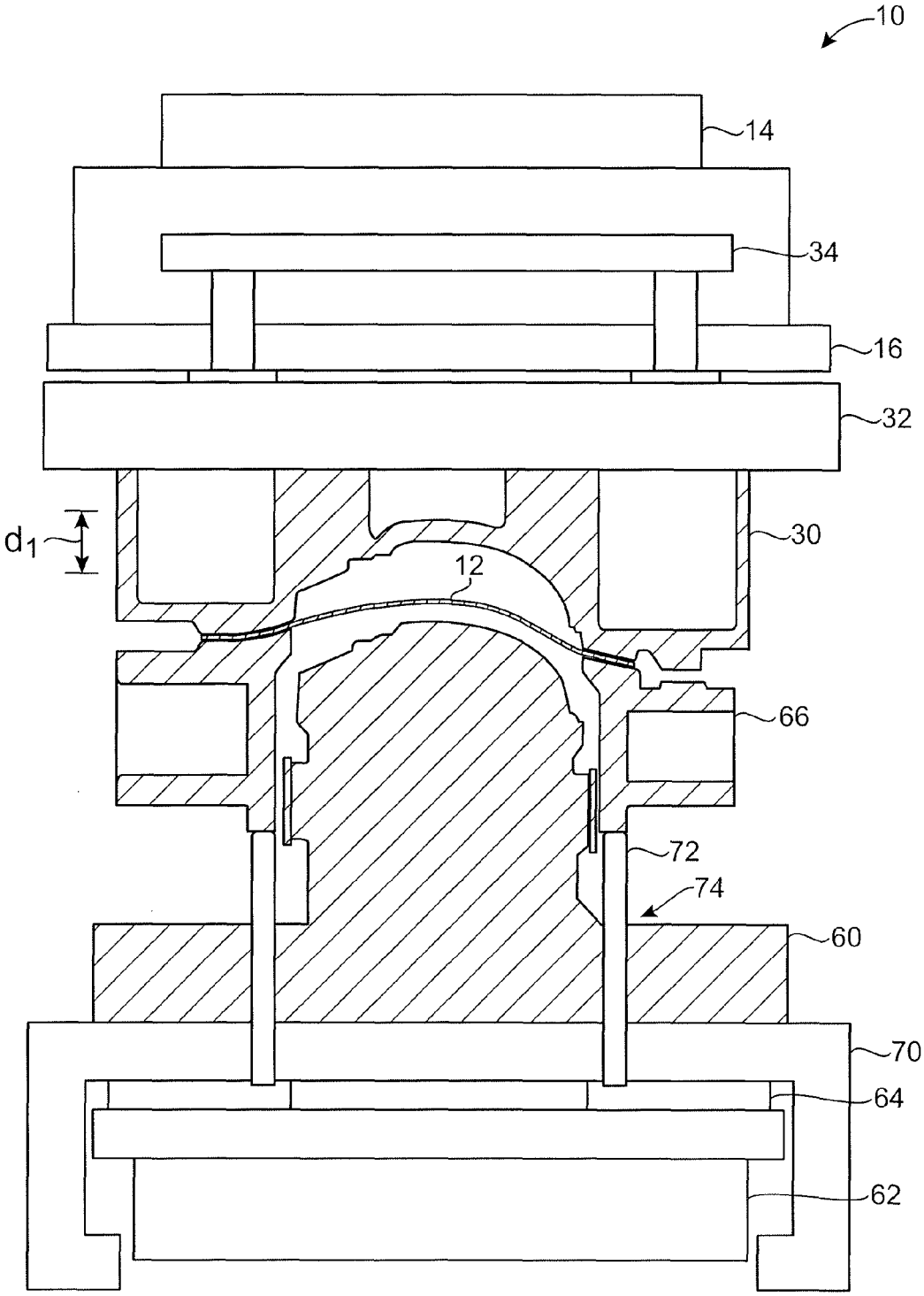
FIG. 1 is a schematic depiction of a draw stage of a stamping operation.

FIG. 1 schematically depicts a draw stage 10 of a stamping operation used to form a deep drawn part from a metal or metal alloy sheet, hereinafter referred to as a work piece 12. The draw stage 10 includes a frame (not shown in FIG. 1) which can be similar to frames found in conventional draw presses.

The draw stage 10 includes at least one drive mechanism, for example, first drive mechanism 14. A first carriage 16, hereinafter referred to as the slide 16, is movably connected with the frame and operably connected with the first drive mechanism 14. The slide 16 is driven by the first drive mechanism 14 so as to be movable with respect to the frame a first distance $d_1$ in a first (downward in FIG. 1) direction. The first drive mechanism 14 may include an eccentric drive mechanism and the first distance $d_1$, i.e. the distance that the slide 16 is movable with respect to the frame, is a function of the eccentricity e of the drive mechanism. The first drive mechanism 14 being an eccentric drive mechanism allows for relatively quick movement of the slide 16 with respect to the frame, which is beneficial for the productivity of the draw stage 10. It is to be understood however, that the first drive mechanism 14 may be any drive mechanism, including, but not limited to, eccentric drive mechanisms, spindle drive mechanisms, hydraulic drive mechanisms, and/or combinations thereof. Although illustrated as including only one drive mechanism, draw stage 10 may include multiple drive mechanisms.

The draw stage 10 also includes an upper die 30. The upper die 30 is movably secured to the slide 16. In a non-limiting example, an upper die mounting plate 32, is positioned between the upper die 30 and the slide 16. In the illustrated embodiment, the upper die 30 mounts to the upper die mounting plate 32, which mounts to the slide 16. In other embodiments, the upper die 30 is mounted directly to the slide 16.

In an embodiment, the draw stage 10 includes a lower die 60, a movable body 62 (hereinafter referred to as "the cushion slide 62"), a carriage 64, a blankholder 66 and a carriage drive mechanism 68. The draw stage 10 further includes a bolster 70. A pin 72 connects the blankholder 66 to the carriage 64. A plurality of pins 72 is provided to connect the blankholder 66 to the carriage 64.

The lower die 60 can be similar to lower dies found in conventional draw presses. In the illustrated embodiment, the lower die 60 includes openings 74 through which the pins 72 extend to connect the blankholder 66 with the carriage 64.

As illustrated, the cushion slide 62 may be generally box-shaped. At least one mechanism, for example, a hydraulic cylinder (not shown in FIG. 1) may be provided below the cushion slide 62. The mechanism provides a resisting force transmitted through the die pins 72 to the blankholder 66 to the slide 16, which results in the force clamping the work piece 12 between the upper die 30 and the blankholder 66. This force can be controlled throughout the stroke.

Figure 2:
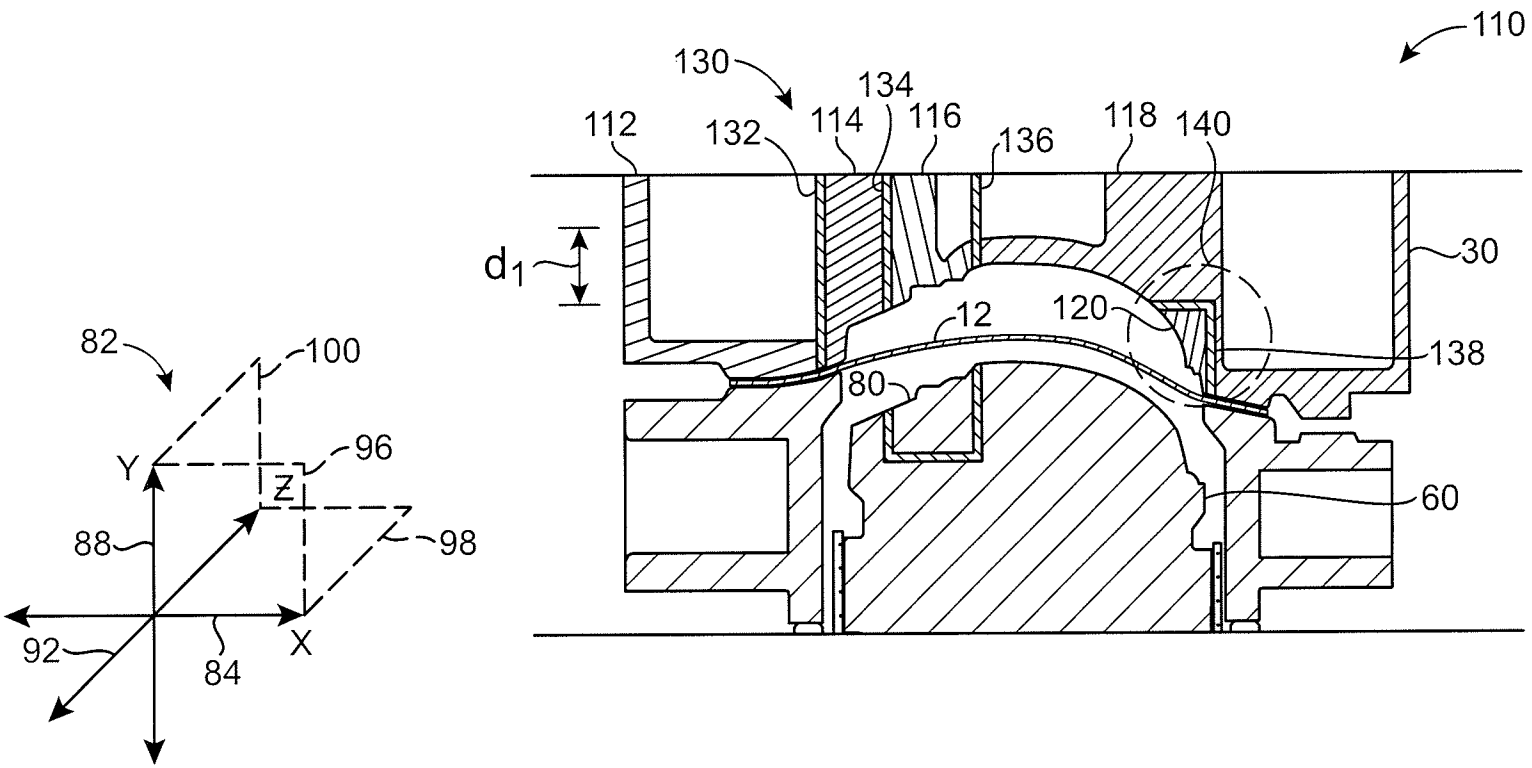
FIG. 2 is a schematic depiction of an exemplary segmented upper die that may be included in the draw stage shown in FIG. 1.

FIG. 2 is a schematic depiction of an exemplary embodiment of upper die 30 that may be included in draw stage 10 (shown in FIG. 1). Due to the large mass of upper die 30 in certain operations, for example, an upper die used in vehicle body panel forming operations, ultrasonic vibration of the entire upper die 30 is not practical. For example, it is not believed that current technology can cause suitable vibration of such a large mass to produce a desired friction reduction, also referred to herein as a lubricating effect. Moreover, if such ultrasonic vibration producing technology is available, it is expected that the energy required to cause suitable vibration of such a large mass would be prohibitively high (e.g., cost of purchasing that amount of energy would be prohibitively expensive and/or usage of that amount of energy would be deemed to be unacceptably high considering environmental factors).

In the exemplary embodiment, the upper die 30 is segmented to facilitate vibration of predefined portions of upper die 30. The predefined portions of segmented upper die 30 that will be ultrasonically vibrated correspond to areas of a drawn part where localized friction reduction is beneficial. For example, a part may have an area or multiple areas where the stress placed on work piece 12 is high during the drawing process. Desire for a part having certain shapes, features, and/or depth leads to these high stress areas, and forming of such parts may not be possible using draw stage 10 without the benefit of friction reduction. In the exemplary embodiment, the portions of segmented die 30 corresponding to these areas are isolated and vibrated to create the localized friction reduction. As referred to herein, the localized friction reduction, also referred to as the lubricating effect, is a reduction in the coefficient of friction between, for example, a portion of upper die 30 and work piece 12. Although described herein as a segmented upper die 30, lower die 60 may also include segments, and segments of upper die 30 and/or lower die 60 may be ultrasonically vibrated. For example, in the embodiment illustrated in FIG. 2, an isolated segment 80 is included within segmented lower die 60.

In order to describe direction of travel and motion of components within draw stage 10, an XYZ coordinate system 82 is provided that defines an X direction 84, a Y direction 88, and a Z direction 92. XYZ coordinate system 82 also defines an X-Y plane 96, an X-Z plane 98, and a Y-Z plane 100. In the illustrated embodiment, work piece 12 is positioned substantially along X-Z plane 98.

In the exemplary embodiment, segmented die 30 includes a plurality of die segments 110, for example, a first die segment 112, a second die segment 114, a third die segment 116, a fourth die segment 118, and a fifth die segment 120. Although illustrated as including five segments, upper die 30 may include any number of segments that allows draw stage 10 to function as described herein. The plurality of die segments 110 are sized such that the energy required to cause suitable vibration of one or more of the plurality of die segments 110 is less than a predefined energy level. The predefined energy level is determined based on, for example, energy cost and/or environmental factors.

In the exemplary embodiment, segmented die 30 also includes a plurality of isolation zones 130, for example, first isolation zone 132, second isolation zone 134, third isolation zone 136, and fourth isolation zone 138. Although illustrated as including four isolation zones, segmented die 30 may include any number of isolation zones that allows draw stage 10 to function as described herein. The plurality of isolation zones 130 are configured to facilitate application of ultrasonic vibrations to selected die segments of the plurality of die segments 110. In other words, the plurality of isolation zones 130 prevent ultrasonic vibrations applied to one of the plurality of die segments 110 from affecting an adjacent die segment of the plurality of die segments 110. The plurality of isolation zones 130 may include any material that prevents ultrasonic vibrations applied to one of the plurality of isolation zones 130 from affecting an adjacent die segment of the plurality of die segments 110.

In the exemplary embodiment, first isolation zone 132 is positioned between first die segment 112 and second die segment 114. Second isolation zone 134 is positioned between second die segment 114 and third die segment 116. Third isolation zone 136 is positioned between third die segment 116 and fourth die segment 118. Furthermore, fourth isolation zone 138 is positioned between fourth die segment 118 and fifth die segment 120.

In the exemplary embodiment, a material, for example, but not limited to, polytetrafluoroethylene (PTFE) is positioned between the fourth die segment 118 and the fifth die segment 120 and defines the fourth isolation zone 138. In an alternative embodiment, a lubricant, for example, some type of oil or grease, is positioned between the fourth die segment 118 and the fifth die segment 120 and defines the fourth isolation zone 138. These materials prevent vibration applied to the fifth die segment 120 from affecting the fourth die segment 118. Furthermore, the material is selected such that pressure applied during the drawing process does not substantially compress the material, which potentially could negatively affect the quality of the drawn part.

Figure 3:
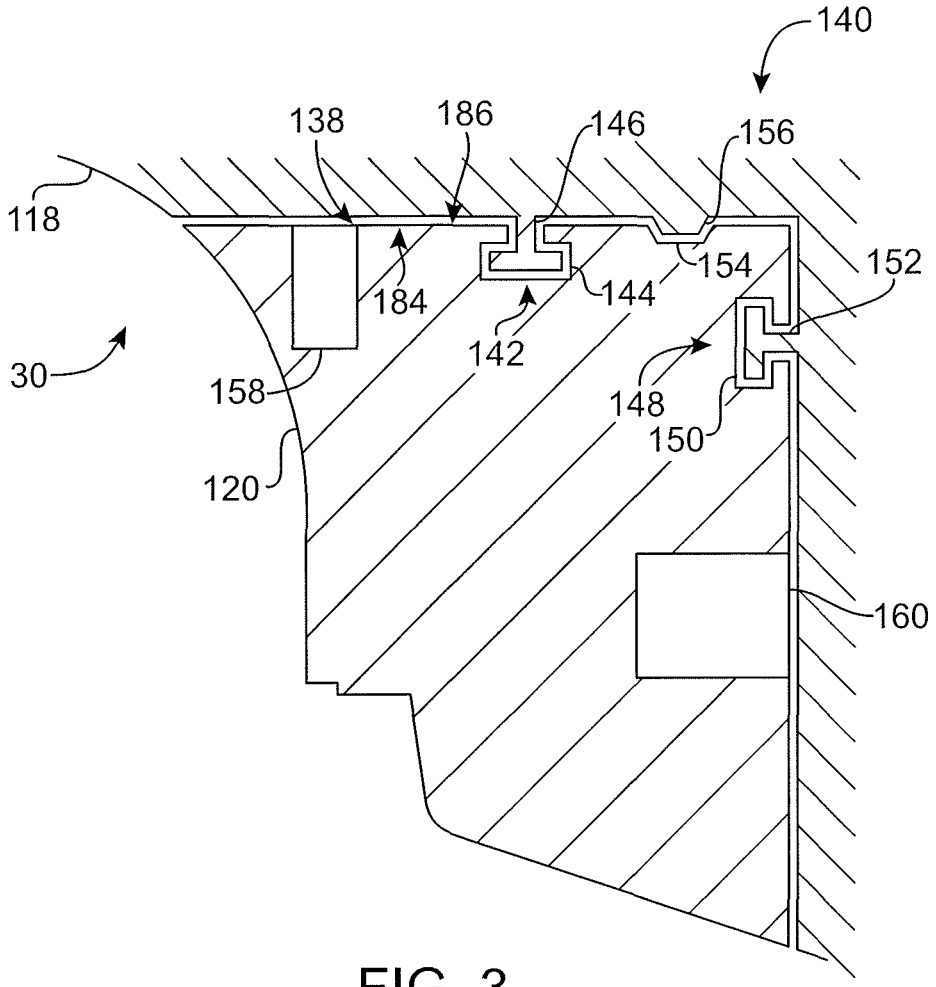
FIG. 3 is a schematic depiction of a portion of the segmented upper die shown in FIG. 2.

FIG. 3 is a schematic depiction of a portion 140 of the segmented upper die 30 shown in FIG. 2. In the exemplary embodiment, segmented upper die 30 includes at least one retaining feature, for example, retaining feature 142 configured to couple the plurality of die segments 110 together, while allowing movement (e.g., vibration) of one die segment with respect to an adjacent die segment. For example, retaining feature 142 may include a channel 144 defined within fifth die segment 120 and a guide 146 coupled to fourth die segment 118. At least a portion of guide 146 fits within channel 144 and couples together fifth die segment 120 and fourth die segment 118 (i.e., substantially prevents movement of fifth die segment 120 in the Y direction 88). Channel 144 extends in the Z direction 92 which allows vibration of fifth die segment 120 in the Z direction 92.

Segmented upper die 30 may also include a second retaining feature 148 that includes a channel 150 and a corresponding guide 152. In the exemplary embodiment, second retaining feature 148 is configured to substantially prevent movement of fifth die segment 120 with respect to fourth die segment 118 in the X direction 84, while allowing vibration of fifth die segment 120 in the Z direction 92. In an alternative embodiment, or in combination with retaining features 142 and 148, upper die 30 may include at least one groove 154 defined within at least one of fifth die segment 120, fourth die segment 118, and isolation zone 138, and a corresponding notch 156 configured to allow vibration in a specific direction and substantially prevent vibration in other directions.

In the exemplary embodiment, at least one transducer, for example, a first transducer 158 and a second transducer 160, are included within fifth die segment 120. Transducers 158 and 160 may include an ultrasonic transducer, a sonotrode, a piezoelectric transducer, and/or any other device capable of converting a first form of energy (e.g., electricity) into mechanical motion (e.g., ultrasonic vibration). In the exemplary embodiment, electricity is provided to transducers 158 and 160, and transducers 158 and 160 cause fifth die segment 120 to vibrate with respect to fourth die segment 118. As an alternative to, or in combination with retaining features 142 and 148, transducers 158 and/or 160 may be directional, that is, cause fifth die segment 120 to vibrate in a predefined direction.

Figure 4:
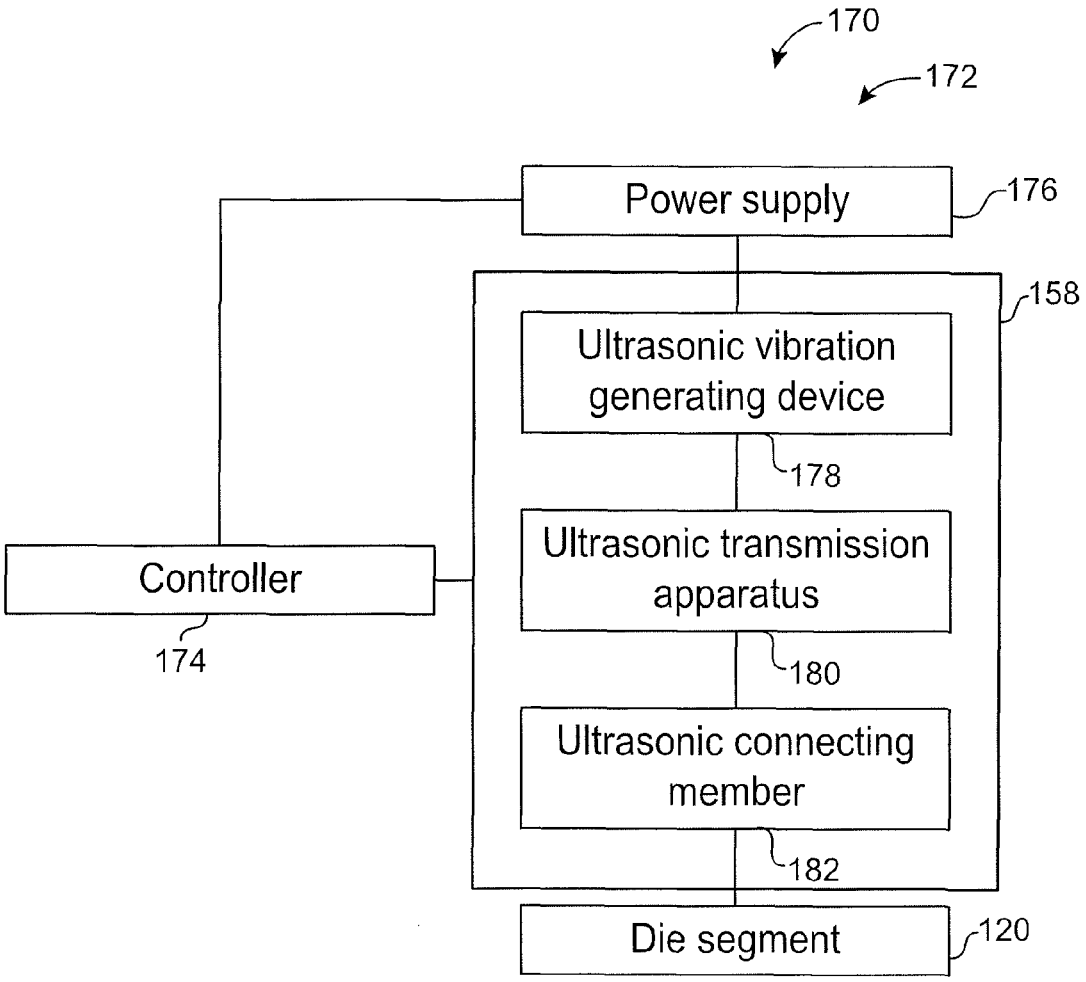
FIG. 4 is a block diagram of an exemplary ultrasonic segmented die system that may be included in the draw stage shown in FIG. 1.

FIG. 4 is a block diagram 170 of an exemplary ultrasonic segmented die system 172 that may be included in a stamping operation, for example, in the draw stage 10 shown in FIG. 1. In the exemplary embodiment, ultrasonic segmented die system 172 includes a system controller 174, a power supply 176, an ultrasonic vibration generating system, for example, ultrasonic transducer 158 (shown in FIG. 3), and at least one die segment, for example, fifth die segment 120 (shown in FIG. 1).

In the exemplary embodiment, ultrasonic transducer 158 includes a vibration generator 178, an ultrasonic transmission apparatus 180, and an ultrasonic connecting member 182. The ultrasonic transducer 158 converts a first form of energy (e.g., electricity) into an ultrasonic vibration. More specifically, ultrasonic vibration generator 178 receives power from power supply 176 and converts the power to mechanical motion. The ultrasonic transmission apparatus 180 is coupled between ultrasonic vibration generator 178 and ultrasonic connecting member 182 and configured to transmit the mechanical motion to the ultrasonic connecting member 182, which is coupled to fifth die segment 120, thereby causing the fifth die segment 120 to vibrate.

In the embodiment shown in FIG. 3, transducer 158 is positioned within fifth die segment 120. In this embodiment, transducer 158 receives energy from power supply 176, which may be positioned external to fifth die segment 120, and ultrasonic connecting member 182 is coupled to an interior surface 184 (shown in FIG. 3) of fifth die segment 120. In an alternative embodiment, transducer 158 may be positioned in a die segment adjacent to the die segment to be vibrated (e.g., fourth die segment 118). In the alternative embodiment, ultrasonic transmission apparatus 180 extends from fourth die segment 118, through isolation zone 138, and is coupled by ultrasonic connecting member 182 to an exterior surface 186 (shown in FIG. 3) of fifth die segment 120.

System controller 174 is communicatively coupled to at least one of power supply 176 and transducer 158 and configured to control operation of the ultrasonic segmented die system 172. For example, system controller 174 may include a processor and a memory configured to store instructions and execute the instructions to control ultrasonic segmented die system 172 in a predefined manner. Controlling operation of the ultrasonic segmented die system 172 includes, but is not limited to, controlling when ultrasonic vibrations are generated, the direction of generated vibrations, and/or the amplitude of generated vibrations. System controller 174 may also be coupled to a second transducer, for example, ultrasonic transducer 160 (shown in FIG. 3) and configured to control when ultrasonic vibrations are generated by transducer 158, when vibrations are generated by transducer 160, the direction of vibrations generated by transducer 158 and/or transducer 160, and the amplitude of vibrations generated by transducer 158 and/or transducer 160.

It should be noted that the embodiments described herein are not limited to any particular system controller and/or processor for performing the processing tasks described herein. The term "processor", as that term is used herein, is intended to denote any machine capable of performing the calculations, or computations, necessary to perform the tasks described herein. The term "processor" also is intended to denote any machine that is capable of accepting a structured input and of processing the input in accordance with prescribed rules to produce an output. It should also be noted that the phrase "configured to" as used herein means that the processor is equipped with a combination of hardware and software for performing the tasks of embodiments of the invention, as will be understood by those in the art. The term processor, as used herein, refers to central processing units, microprocessors, microcontrollers, reduced instruction set circuits (RISC), application specific integrated circuits (ASIC), logic circuits, and any other circuit or processor capable of executing the functions described herein.

In the exemplary embodiment, transducer 158 and/or segmented upper die 30 may be configured to cause fifth die segment 120 to vibrate in a predefined direction. For example, transducer 158 and/or segmented die 30 may be configured to cause fifth die segment 120 to vibrate only in the Z direction 92. Transducer 158 and/or segmented die 30 may be configured to cause fifth die segment 120 to vibrate only in the X direction 84. Transducer 158 and/or segmented die 30 may be configured to cause fifth die segment 120 to vibrate only in Y direction 88. Moreover, transducer 158 and/or segmented die 30 may be configured to cause fifth die segment 120 to vibrate in any predefined direction or combination of directions that allows segmented die 30 to function as described herein. The predefined direction of vibration is determined based at least partially on part geometry and/or testing to determine the direction of vibration that creates the desired friction reduction. Moreover, the predefined direction of vibration may be fixed throughout a press operation, or may be variable such that the direction of vibration changes periodically or continuously throughout the press operation.

In the exemplary embodiment, at least one of transducer 158 and segmented die 30 are configured to cause fifth die segment 120 to vibrate at a predefined amplitude. The predefined amplitude may be fixed throughout a press operation, or may be variable such that the amplitude of vibration changes periodically or continuously throughout the press operation.

In the exemplary embodiment, the plurality of die segments 110 included within segmented die 30 allow, for example, fifth die segment 120 to vibrate in a first predefined direction and fourth die segment 118 to concurrently vibrate in a second predefined direction, wherein the first predefined direction is different than the second predefined direction. Furthermore, the plurality of die segments 110 included within segmented die 30 allow, for example, fifth die segment 120 to vibrate at a first predefined amplitude and fourth die segment 118 to vibrate at a second predefined amplitude, wherein the first predefined amplitude is different than the second predefined amplitude. Furthermore, the plurality of die segments 110 included within segmented die 30 allow, for example, fifth die segment 120 to vibrate at times within the press operation where vibration of second segment 114 is not desired. Moreover, the plurality of die segments 110 included within segmented die 30 allow, for example, vibration of fifth die segment 120 to be varied in a first predefined manner during the press operation and vibration of fourth die segment 118 to be varied in a second predefined manner, wherein the first predefined manner is different than the second predefined manner. Moreover, any combination of direction, amplitude, timing, and variance of the vibration of fifth die segment 120 can be different than the vibration of fourth die segment 118.

Figure 5:
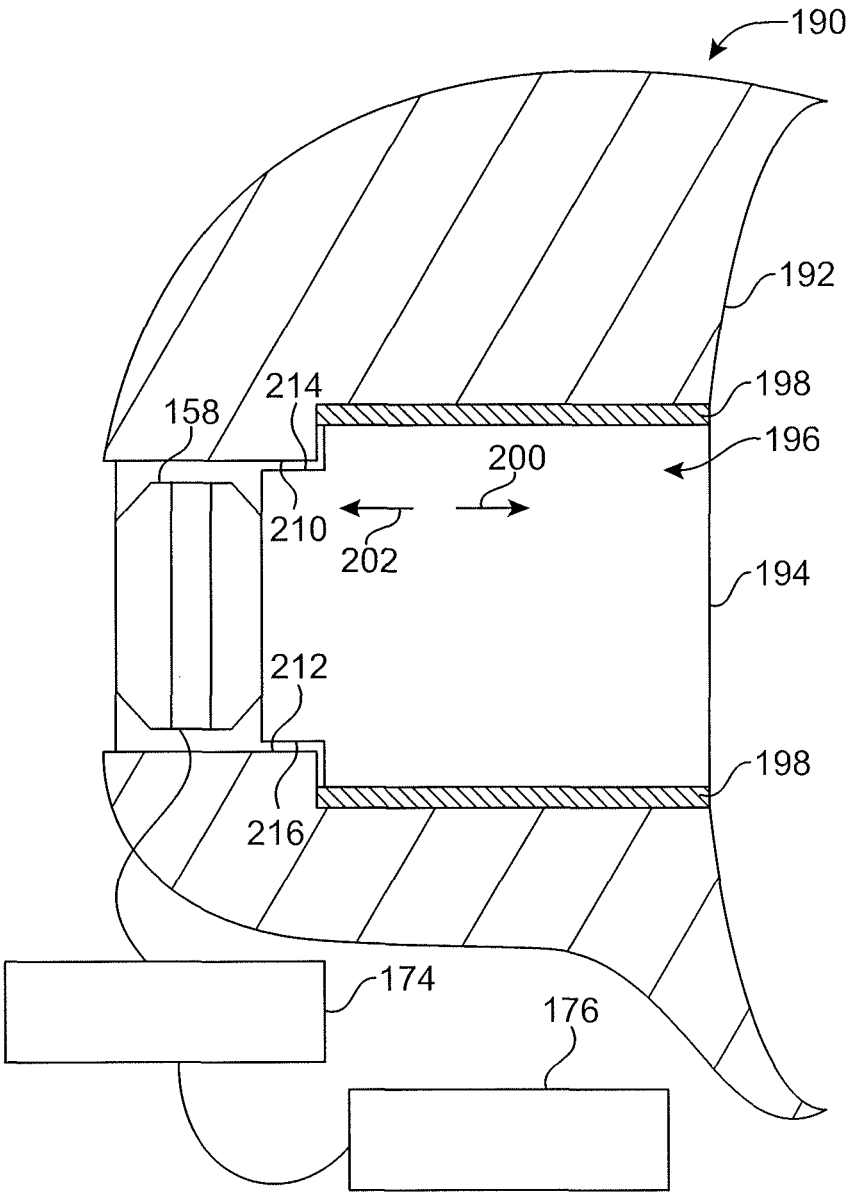
FIG. 5 is a schematic depiction of an alternative embodiment of the segmented die (shown in FIG. 3) that may be included in the ultrasonic segmented die system shown in FIG. 4.

FIG. 5 is a schematic depiction of an alternative embodiment 190 of the segmented die 30 (shown in FIG. 3) that may be included in the ultrasonic segmented die system 172 (shown in FIG. 4). In the alternative embodiment, segmented die 190 includes a die body 192 and a first die segment 194. An opening 196 is defined within die body 192 and first die segment 194 is positioned at least partially within opening 196. First die segment 194 is isolated from die body 192 by an isolation material 198.

In the alternative embodiment, an ultrasonic vibration generator, for example, transducer 158, is positioned between a die body 192 and first die segment 194. Transducer 158 is configured to cause first die segment 194 to move in a first direction 200 and a second direction 202. Furthermore, die body 192 and first die segment 194 may include at least one feature that allows first die segment 194 to move only in first direction 200 and second direction 202. More specifically, die body 192 includes a first surface 210 and a second surface 212. First die segment 194 includes a first surface 214 and a second surface 216. First surface 210, second surface 212, first surface 214 and second surface 216 are configured to limit movement of first die segment 194 in directions other than first direction 200 and second direction 202.

Moreover, in the illustrated embodiment, a controller, for example, controller 174, receives power from a power supply, for example, power supply 176. Controller 174 controls when power is supplied to transducer 158 and/or how much power is supplied to transducer 158.

Figure 6:
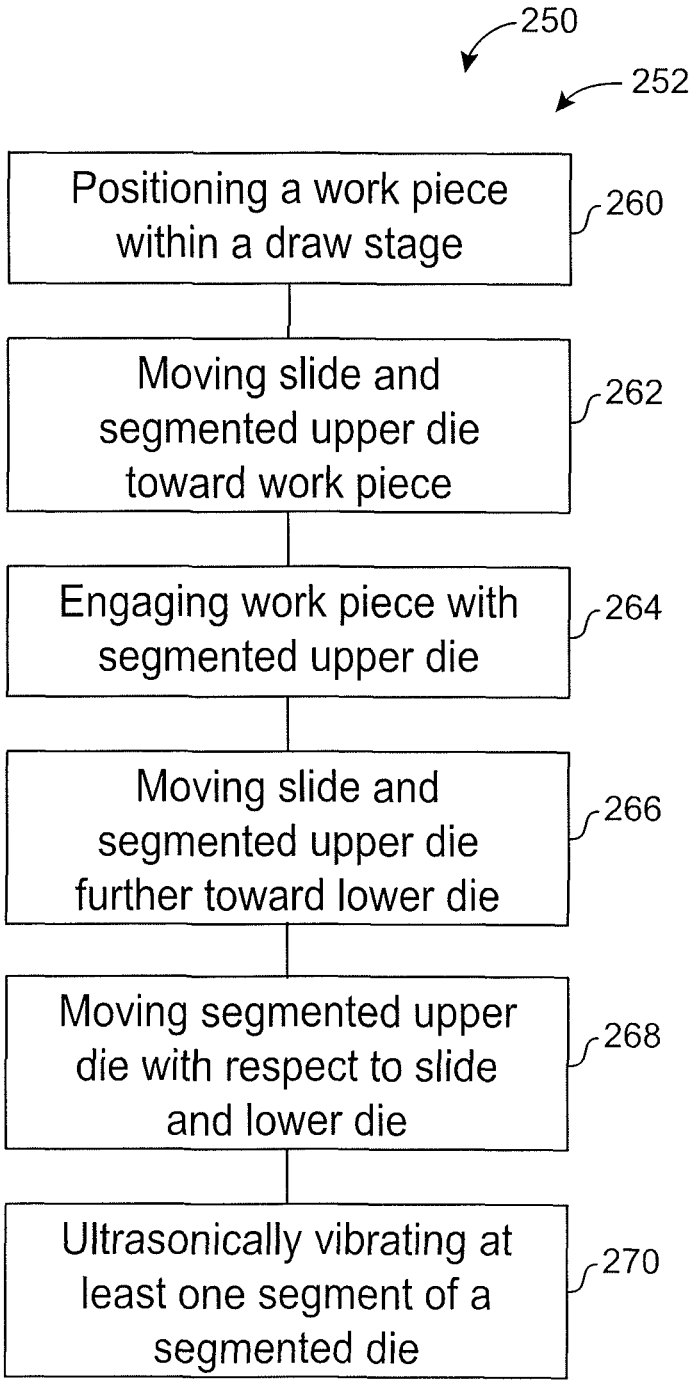
FIG. 6 is a flow chart of an exemplary method of forming a part, for example, using the segmented upper die shown in FIG. 2.

FIG. 6 is a flowchart 250 of an exemplary method 252 of applying ultrasonic vibrations during a stamping operation, for example, using the segmented upper die 30 in draw stage 10. In the exemplary embodiment, method 252 includes positioning 260 a work piece, for example, work piece 12 (shown in FIG. 1), within a draw stage, for example, draw stage 10 (shown in FIG. 1). In the exemplary embodiment, work piece 12 is positioned 260 between segmented upper die 30 and blankholder 66 (both shown in FIG. 1).

Method 252 also includes moving 262 slide 32 and segmented upper die 30 toward work piece 12 using a drive mechanism, for example, first (eccentric) drive mechanism 14 (shown in FIG. 1).

Method 252 further includes engaging 264 work piece 12 with segmented upper die 30. Method 252 further includes moving 266 slide 32 and segmented upper die 30 further toward lower die 60 still using first drive mechanism 14. This downward movement of the segmented upper die 30 results in downward movement of the blankholder 66 adjacent to the lower die 60 and downward movement of the cushion slide 62 connected with the blankholder 66 (shown in FIG. 1). Pressure between blankholder 66 and upper die 30 may be controlled through use of, for example, hydraulic cylinders. The downward movement of the segmented upper die 30 continues until the slide 16 has moved the first distance $d_1$, which is based on the eccentricity e of the first drive mechanism 14. The slide 16 is capable of moving the entire distance $d_1$, but the slide 16 can be moved any fraction thereof.

In some embodiments, after slide 16 has moved the first distance $d_1$, method 252 may also include moving 268 segmented upper die 30 with respect to the slide 16 and the lower die 60 using the second drive mechanism 34 (shown in FIG. 1), which is connected with the slide 16 for movement therewith. As explained above, the second drive mechanism 34 is operably connected with the segmented upper die 30 to allow for relative movement of the upper die 30 with respect to the slide 16.

In the exemplary embodiment, method 252 further includes ultrasonically vibrating 270 at least one segment, for example, first die segment 112 (shown in FIG. 2), of segmented upper die 30. Ultrasonically vibrating 270 first die segment 112 may include activating a vibration generating device, for example, transducer 158 (shown in FIG. 3). Ultrasonically vibrating 270 first die segment 112 may include selectively coupling at least a portion of transducer 158 to first die segment 112. Moreover, ultrasonically vibrating 270 first die segment 112 may include selectively providing transducer 158 with energy, which causes transducer 158 to vibrate first die segment 112.

First die segment 112 may be ultrasonically vibrated 270 during the entirety of the movement 262 of slide 32 and segmented upper die 30 toward work piece 12, the movement 266 of slide 32 and segmented upper die 30 toward lower die 60, and the movement 268 of segmented upper die 30 with respect to the slide 16 and the lower die 60. Alternatively, first die segment 112 may be ultrasonically vibrated 270 for any portion or portions of movement 262, movement 266, and/or movement 268. As described above, ultrasonically vibrating 270 at least one segment of segmented upper die 30 may include varying one or more of the direction of vibration and the amplitude of vibration achieved by each respective segment. Ultrasonically vibrating 270 at least one segment may also include ultrasonically vibrating a first segment in a different manner than an adjacent, second segment. Ultrasonically vibrating 270 at least one segment of segmented upper die 30 creates a localized friction reduction between work piece 12 and upper die 30 and/or lower die 60. The friction reduction allows for a deeper draw of the work piece 12. The friction reduction may also prevent defects in a drawn part including, but not limited to, fracturing, cracking, and/or wrinkling of work piece 12. Furthermore, the reduction in friction may reduce galling (i.e., surface wear of tool), and may reduce or eliminate the cost of lubricants.

The methods, systems, and apparatus described herein facilitate efficient and economical production of deeply drawn parts. Exemplary embodiments of methods, systems, and apparatus are described and/or illustrated herein in detail. The methods, systems, and apparatus are not limited to the specific embodiments described herein, but rather, components of each system or apparatus, as well as steps of each method, may be utilized independently and separately from other components and steps described herein. Each component, and each method step, can also be used in combination with other components and/or method steps.

When introducing elements/components/etc. of the methods and systems described and/or illustrated herein, the articles "a", "an", "the", and "said" are intended to mean that there are one or more of the element(s)/component(s)/etc. The terms "comprising", "including", and "having" are intended to be inclusive and mean that there may be additional element(s)/component(s)/etc. other than the listed element(s)/component(s)/etc.

Although specific features of various embodiments described herein may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A draw die for use in a draw stage configured to process a work piece in a drawing operation, said draw die comprising:

a first segment;

a second segment positioned adjacent to said first segment, wherein at least one of said first segment and said second segment comprises an ultrasonic vibration generating system configured to receive power from a power supply; and a substantially non-compressible isolation material positioned between said first segment and said second segment and configured to substantially isolate said second segment from ultrasonic vibrations of said first segment.

2. The draw die in accordance with claim 1, wherein said first segment and said second segment are included within an upper die of the draw stage.

3. The draw die in accordance with claim 1, wherein said first segment and said second segment are included within a lower die of the draw stage.

4. The draw die in accordance with claim 1, wherein the position of said first segment within the draw die corresponds to an area of the work piece under high stress relative to the rest of the work piece during the drawing operation.

5. The draw die in accordance with claim 1, wherein the ultrasonic vibration generating system is configured to ultrasonically vibrate at least one of said first segment and said second segment during the drawing operation.

6. The draw die in accordance with claim 1, wherein at least one of said first segment and said second segment is configured to be coupled to the ultrasonic vibration generating system.

7. The draw die in accordance with claim 1, wherein at least one of said first segment and said second segment comprises a retaining feature configured to couple said first segment to said second segment while allowing movement of said first segment with respect to said second segment.

8. The draw die in accordance with claim 7, wherein said retaining feature includes a channel defined within one of said first segment and said second segment and a guide extending from the other of said first segment and said second segment, wherein said guide fits within said channel and couples said first segment to said second segment.

9. A method of forming a drawn part from a work piece using a draw stage of a stamping operation, said method comprising:

providing at least one segmented draw die on the draw stage, the at least one draw die including at least a first segment and a second segment substantially isolated from ultrasonic vibrations of the first segment by a substantially non-compressible isolation material between the first segment and the second segment;

positioning the work piece within the draw stage;

moving the segmented draw die toward the work piece;

engaging the work piece with the segmented draw die; and ultrasonically vibrating at least one of the first segment and the second segment.

10. The method in accordance with claim 9, wherein ultrasonically vibrating at least one of the first segment and the second segment comprises activating a vibration generating device.

11. The method in accordance with claim 9, wherein ultrasonically vibrating at least one of the first segment and the second segment comprises selectively coupling a vibration generating device to at least one of the first segment and the second segment.

12. The method in accordance with claim 9, wherein ultrasonically vibrating at least one of the first segment and the second segment comprises providing a vibration generating device included within the first segment with energy, causing the vibration generating device to vibrate the first segment.

13. The method in accordance with claim 9, wherein ultrasonically vibrating at least one of the first segment and the second segment comprises controlling at least one of a direction of the vibration and an amplitude of the vibration.

14. An ultrasonic segmented die system, comprising:

a segmented die that includes at least: a first die segment, a second die segment, and a substantially non-compressible isolation material positioned between the first and second die segments and configured to substantially isolate the second die segment from ultrasonic vibrations of the first die segment;

a power supply;

an ultrasonic vibration generating system operatively coupled to at least one of said first die segment and said second die segment, wherein said ultrasonic vibration generating system is configured to receive power from said power supply; and a system controller communicatively coupled to, and configured to control operation of, at least one of said power supply and said, ultrasonic vibration generating system.

15. The system of claim 14, wherein said ultrasonic vibration generating system comprises an ultrasonic vibration generating device, an ultrasonic transmission apparatus, and an ultrasonic connecting member, wherein said ultrasonic transmission apparatus is coupled between said ultrasonic vibration generator and said ultrasonic connecting member and configured to transmit the mechanical motion to said ultrasonic connecting member which is coupled to at least one of said first die segment and said second die segment.

16. The system of claim 14, wherein said ultrasonic vibration generating system is at least one of positioned at least partially within, and operatively coupled to, at least one of said first and second die segment.

17. The system of claim 14, wherein controlling operation of said ultrasonic segmented die system comprises controlling when ultrasonic vibrations are generated, the direction of generated vibrations, and the amplitude of generated vibrations.

18. The system of claim 14, wherein at least one of said first die segment and said die second segment comprises a retaining feature configured to couple said first die segment to said second die segment while allowing movement of said first die segment with respect to said second die segment.

* * * * *